US006160319A

United States Patent [19]

Marougi et al.

[11] Patent Number: 6,160,319

[45] Date of Patent: Dec. 12, 2000

[54] VEHICLE KEY WITH INTEGRATED ELECTRICAL COMPONENTS

[75] Inventors: LeeAnn Marougi, Bloomfield Township; Marian O. Borzea, Farmington Hills; Joseph D. King, Ann Arbor, all of Mich.

[73] Assignee: Lear Automotive Dearborn, Inc., Southfield, Mich.

[21] Appl. No.: 09/234,210

[22] Filed: Jan. 20, 1999

[51] Int. Cl.[7] ..... E05B 47/02

[52] U.S. Cl. ..... 307/10.5; 70/256; 70/413; 70/416; 307/9.1

[58] Field of Search ..... 307/10.1, 10.4, 307/10.5, 10.2; 340/825.31; 70/256, 393, 413, 416, 278; 180/287

[56] References Cited

U.S. PATENT DOCUMENTS

| | | | |
|---|---|---|---|
| 5,433,096 | 7/1995 | Janssen et al. | 70/413 |
| 5,561,331 | 10/1996 | Suyama et al. . | |
| 5,561,420 | 10/1996 | Kleefeldt et al. | 340/825.31 |
| 5,596,317 | 1/1997 | Brinkmeyer et al. | 340/825.31 |
| 5,616,966 | 4/1997 | Fischer et al. | 307/10.5 |
| 5,671,621 | 9/1997 | Watanuki et al. | 70/278 |
| 5,734,330 | 3/1998 | Nakamura | 340/825.31 |
| 5,790,014 | 8/1998 | Campbell et al. | 307/10.5 |

*Primary Examiner*—Albert W. Paladini
*Attorney, Agent, or Firm*—MacMillan, Sobanski & Todd, LLC

[57] ABSTRACT

An improved key system incorporates a number of electrical components. In one main aspect, the key is provided with electrical communication to components on the vehicle when the key is inserted into the ignition. The key connects to an antenna associated with the vehicle, such that the combined antenna size is greater than would otherwise be possible. In this application, the antenna is utilized for garage door opener purposes, and a switch is mounted on the key for actuation of the garage door opener. In another aspect, the key is recharged when inserted into the ignition. Further, the key may be provided with various other functions such as memo, vehicle deactivation, two-way communication, and other security applications. In embodiments of the key, the switches are positioned relative to a thumb area such that inadvertent actuation of the switches is made less likely.

17 Claims, 2 Drawing Sheets

VEHICLE KEY WITH INTEGRATED ELECTRICAL COMPONENTS

BACKGROUND OF THE INVENTION

This invention relates to a vehicle key which carries a number of optional electrical components.

Vehicle keys are typically associated with key fobs which perform a number of functions. As an example, the key fob is typically provided with door unlock, door lock and trunk open functions. Additional electronic features and devices are frequently being incorporated into the key fob. It has been proposed to incorporate flashlights, two-way communication, etc. At the same time, the key fobs are desirably being made as small as possible. The two goals are at least somewhat contradictory.

As one example, it has been proposed that a garage door opener be incorporated into the key fob. Garage door openers have typically been provided by a separate actuation member mounted with the cab of the vehicle. This does cause some concerns in that a thief who steals the vehicle is able to actuate the garage door opener. The garage door opener could be incorporated into the key fob such that the operator need not carry more than one control mechanism. However, garage door openers do require an antenna to ensure that its transmitted signal carries far enough such that the garage door receiver receives the signal. Providing a large antenna within a key fob does create concerns with regard to the size of the key fob. Thus, garage door openers have not typically been practically incorporated into key fobs.

Finally, the ultimate in making the key fob smaller would be to eliminate the key fob altogether and incorporate the controls in the key itself. Known keys do not have switches which are ideally designed. It would be desirable to position switches on the key to reduce the likelihood of accidental actuation.

SUMMARY OF THE INVENTION

In one aspect of this invention, circuit traces are provided on the key and associated with a transmitter for sending signals such as RF signals to actuate a device. The transmitter may preferably be a garage door opener, such that upon actuation of a switch, an RF signal is transmitted to the garage door associated with the key to open the garage door. In a further aspect of this invention, circuit traces formed on the key communicate with an antenna inside the vehicle when the key is inserted into the ignition. This provides a relatively large antenna within the vehicle body, while still providing the switch on a relatively small vehicle key.

The key may also be provided with an embedded battery. The circuit traces can also communicate with a source of power in the vehicle such that the battery is recharged. The traces can thus provide both functions.

In another benefit flowing from this combination, the garage door opener generally requires the proper vehicle key be inserted into the appropriate vehicle. This will provide additional security for the garage door opener. A thief with only the vehicle, or only the key will not be able to easily open the garage door.

In further features of this invention, the key is provided with a number of optional features. In one feature, a memo function is provided on the key by incorporating a microphone and a recorder along with a speaker for playing back the memo. In this way, the operator of the vehicle is able to store a short memo on the key. Again, this is particularly practical given the rechargeable battery associated with the key.

In other features of this invention, the key can be provided with a number of reconfigurable switches. The switches may have several different possible functions. As an example, one switch may be actuated between two positions to change the actuation state of a further set of switches. Thus, when the first switch is in a first position, the second set of switches may control various functions on the vehicle. On the other hand, if the first switch moves to a second position, the second set of switches may then actuate home or garage applications. Thus, one of the second switches may be utilized to open the doors on a vehicle when the first switch is in its first position, and that same second switch may open the door of a home, or disconnect its security system, when the first switch is in its second position.

In other features of this invention, the key may be provided with a receiver and transmitter. The receiver and transmitter can be utilized for a number of functions, including a disable/enable function as described below. Further, the garage door opener can be incorporated into the transmitter and receiver. Typically, key fobs are provided with at least a transmitter to transmit an RF signal to the vehicle.

In other features, the key is provided with a disable/enable function for the vehicle. In aspects of this invention, the key is operable to disable the vehicle by actuation of a switch. This will allow the user of the key to disable the vehicle from the key, such that the vehicle will not be operable until it is again enabled. This may be helpful such as when the vehicle has been left with a valet, and the user maintains the key with the switch, and provides the valet with a separate key. As one example, the user may actuate the vehicle to disable it once sufficient time has elapsed such that the valet should have already parked the car. Of course, given the type of valet parking this may sometimes not be desirable.

In other features, the enable/disable may be automatically provided by the user of the key with the proper vehicle. In one example, the vehicle could sense a signal from the key transmitted over the circuit traces, such as those discussed above. In this way, the coding member for supplying the proper code for the vehicle can be embedded with the key, and its signal transmitted over the circuit traces. This provides a more robust structure than the existing systems for providing a coded signal from a key to a vehicle.

In further features of this invention, the switches associated with the key may be positioned relative to a hollow on the key such that they are unlikely to be accidentally actuated. In one embodiment, the switches are positioned forwardly of a hollow, wherein the hollow is designed to receive the fingers of the operator such that the operator is unlikely to accidentally actuate the switches.

In a second embodiment, the switches are formed in the body of the key, and in an end face rearward of the hollow. Again, this structure will reduce the likelihood of the operator accidentally actuating a switch.

These and other features of the present invention can be best understood from the following specification and drawings, the following of which is a brief description.

DETAILED DESCRIPTION OF A PREFERRED EMBODIMENT

Figure 1A:
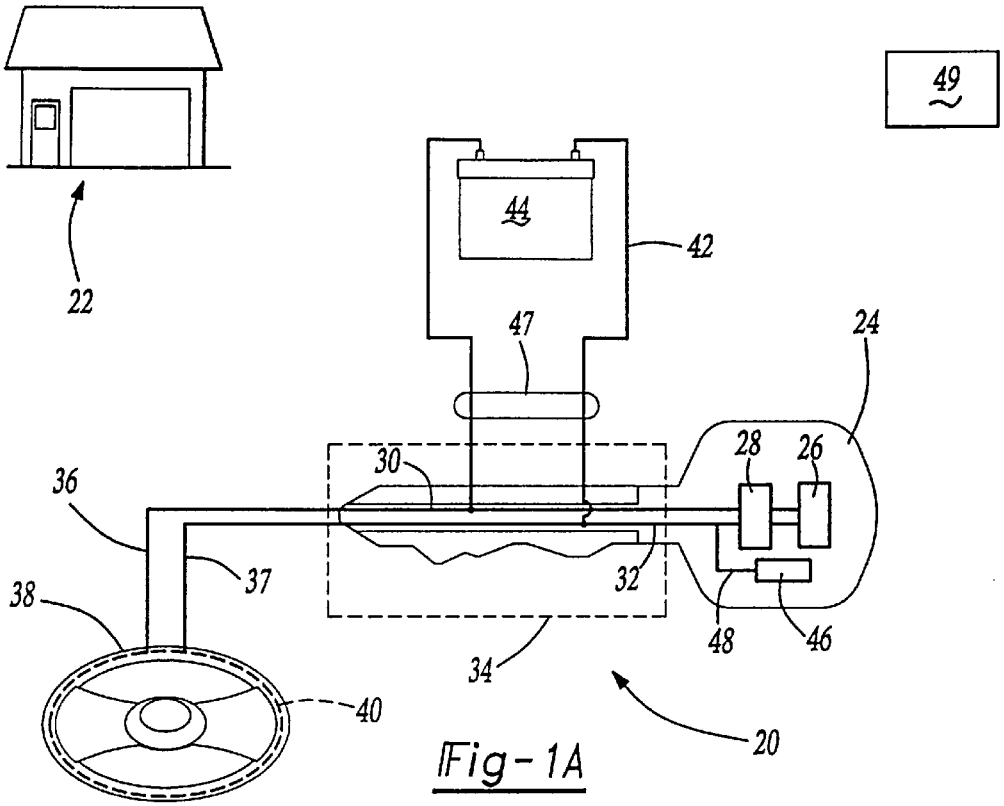
FIG. 1A is a schematic view showing one feature of this invention.

A system 20 is illustrated in FIG. 1A for performing functions such as opening a garage door 22. The key 24 is associated with a garage door opener switch 26, and a garage door opener transmitter 28. Signals from the transmitter 28 pass over a pair of circuit traces 30 and 32 which are formed on a shank of the key. The key body on which the traces 30, 32 is formed is preferably formed to be non-conductive. When the key is inserted into a vehicle ignition 34, shown schematically, the circuit traces 30 and 32 align with and contact antenna leads 36 and 37. As shown in this figure, the antenna may be embedded in a steering wheel 38 with the antenna 40 surrounding the circumference of the steering wheel. The incorporation of an antenna into the steering wheel or other interior vehicle trim components, is the subject of co-pending Patent application Ser. No. 09/373, 692. Of course, other locations for the antenna may also be utilized. This aspect of the invention simply flows to the use of a key and an antenna wherein there is electrical contact when the key is inserted into the ignition.

Notably, while the key 24 and antenna 40 are shown hard-wired together, it is possible to use a RF link to communicate between the key 24 and the antenna 40. The transmitter could transmit to a vehicle band receiver that is connected into the antenna.

With this arrangement, further security is provided in that the transmitter 28 is not stored in the vehicle. The garage door opener button 26 and transmitter 28 lack sufficient signal strength to practically send out a signal without the remainder of the antenna 40. A thief with the key only would need to stand very close to the garage door 22 to open the garage door 22 without the associated vehicle bound antenna 40. That is, the small traces 30 and 32 would be insufficient to send a signal a significant distance to open garage door 22, unless the key 24 is inserted into the vehicle. Thus, a thief who has stolen the vehicle will be unable to easily open the garage door 22 without the associated key 24.

Another feature of the key 24 is that it may be separately utilized without the garage door function of the key 24. A power line 42 leads from a power source, such as the vehicle battery 44, to the circuit traces 30 and 32. The power line supplies the circuit trace 32 with power from the battery 44 which charges a battery 46 on the key 24 through a line 48. The technology for passing power over antenna lines is known, and forms no portion of this invention. Now, when the key 24 is plugged into the ignition 34, the battery 46 is charged as necessary. In this way, the battery 46 will be recharged frequently, and a relatively small battery may be mounted within the key, and still be called upon to perform a number of functions. In the prior art, there may have been some reluctance to incorporate additional electrical components into the key fob, as the power drain on the battery would be so great that the battery would die frequently. With the present invention, the battery is being recharged whenever it is in the ignition, and the above concerns are less of a problem.

A control 47, shown schematically, controls the supply of power to recharge the battery. The control 47 may be as known, and be operable to ensure the battery 46 is not overcharged. Further, a separate recharging circuit 49 may also be utilized, on the vehicle, or removed from the vehicle, for recharging the key remote from the ignition 34. The technology for achieving the disclosed functions is well within the skill of a worker in this art.

Figure 1B:
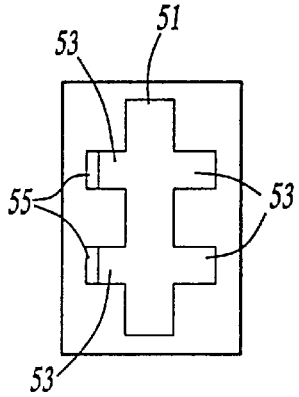
FIG. 1B shows a feature of the invention.

The key 24 illustrated in FIG. 1A can only be inserted in one orientation. Of course, many keys can be inserted in either orientation. FIG. 1B shows a feature for use on a key which can be inserted in either orientation.

FIG. 1B shows the key 24 having circuit traces 30, 32 on each side. The circuit traces 30 may be associated with positive connections to the transmitter 28 and battery 46 and the traces 32 may be associated with the negative connections. As shown schematically in FIG. 1B, the ignition 34 is provided with an opening 51 for receipt of the key. The opening 51 is provided with four notches 53. Electrical contacts 55 are provided within the notches 53 on one side of the opening 51, but not on the other. Thus, when the key is inserted into the opening 51, one of the circuit traces 30 will be associated with one of the notches 53 having the contact 55, and one of the circuit traces 32 will be associated with a notch 53 having the contact 55. The orientation of the positive and negative circuit traces will always be proper, regardless of whether the key is inverted.

Figure 2:
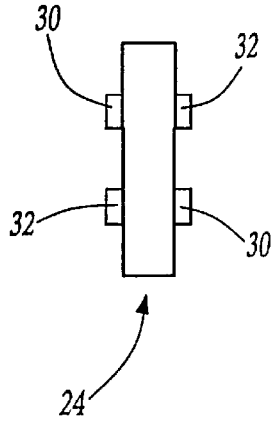
FIG. 2 is a schematic view of a first embodiment key according to the present invention.
Figure 2:
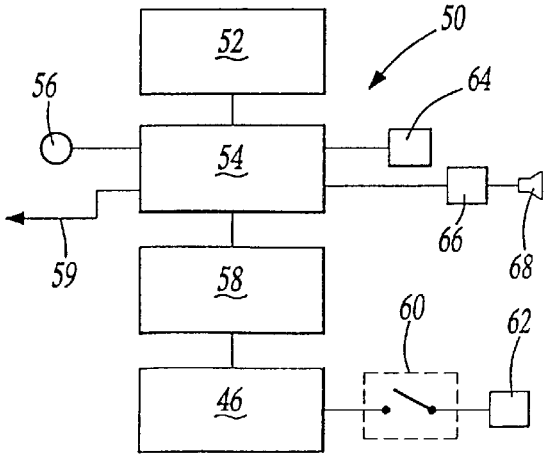

FIG. 2 is a schematic view showing various other electrical components which can be incorporated into the vehicle key. This is particularly practical given the rechargeable battery on the key.

Key 50 incorporates a transmitter/receiver 52 for sending RF signals. This may incorporate the garage door transmitter 28 as discussed above. A control 54, which could be a field programmable gate array, or any other type of control, receives and sends signals between the various components on the key. A microphone 56 is incorporated into the control 54 for providing memo capabilities. A switch associated with the key may actuate the control 54 to put it into a record mode. The operator is then able to store a short message in the control at memory 58 through the use of the microphone 56. The message can be recalled at a later point in time, and played over a speaker 68 which is associated with an amplifier 66. The replay can be programmed to occur automatically at a certain time, or could occur when an appropriate switch is activated. Again, due to the rechargeable battery 46, this is a more practical application than would be the case without the rechargeable battery.

A line 58 leads to engine control structure, such as enable/disable controls line 59. A switch 60 can be actuated to control a light 62, which provides a flashlight function. Control buttons 64 also provide signals to the control 54 to provide various operations.

In several functions of this invention, the control 54 may send a coding signal over the traces 30, 32 to a control on the vehicle. Vehicle deactivation technologies are known wherein only an appropriate signal from a vehicle key will enable the vehicle to be started. However, in known switches, the coding elements on the keys have tended to send RF signals. Those coding elements have been exposed to the elements, and have thus not been as robust as would be desirable. With the above feature of this invention, the coding element is protected and may be embedded within the control, with the circuit traces being the only exposed component. This is a robust solution.

Other methods of communicating the key to the vehicle for enabling or disabling the vehicle may be utilized in other embodiments. As one example, the receiver on the key may receive a coded signal from the vehicle. The vehicle could be continuously transmitting this signal. When the key receives the appropriate signal (i.e., indicating the key is close to the appropriate vehicle), the key may then transmit an appropriate coding signal that would cause the vehicle to move out of its deactuation mode and allow the vehicle to be started.

In another similar feature, the transmitter/receiver 52 is functional to provide the operator with a signal indicating that a particular security system may be breached. As an example, if a vehicle associated with the key has been broken into, a signal could be transmitted form the vehicle to the key that would then cause a signal to be provided to the operator. A similar signal could be sent from a home security system. This would provide additional safety to the operator.

Further, the key may be provided with a switch that enables the operator to disable the vehicle. This would be useful, as for example, when the operator has handed one key to a valet. After a short period of time, the operator may then disable the vehicle, assuming that the vehicle has now been parked by the valet. With some types of valet parking this may not be practical.

Again, all of these functions are made more practical by the rechargeable battery.

Figure 3A:
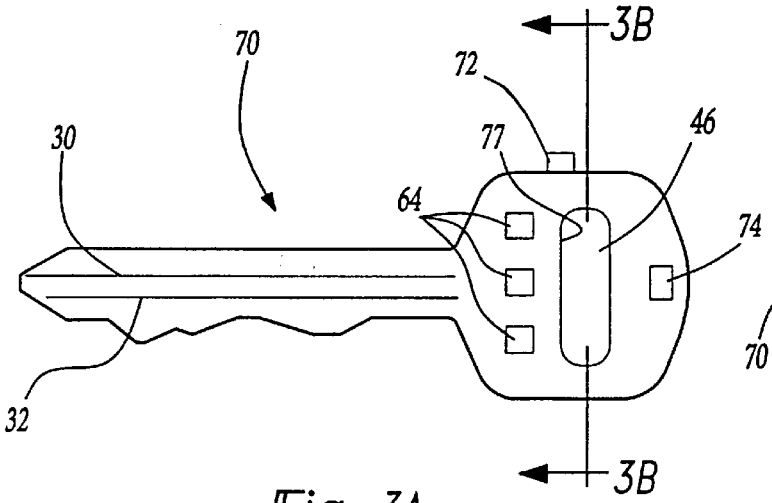
FIG. 3A shows a key body.

As shown in FIG. 3A, a switch embodiment 70 incorporates the circuit traces 30 and 32, and the various components described above. A first set of switches 64 is associated with a mode switch 72. The mode switch 72 allows changing of the mode of operation of the switches 64. Thus, if the mode switch were in a first position, the switches 64 could perform the normal vehicle control functions which are typically associated with key fobs. As an example, one switch could open the door, one switch could lock a door, and a third switch could open a trunk. If the mode switch 72 is moved to its second position, those three switches may then control various home security systems such as alarms, or door lock systems. The electrical connections to provide these functions are well within the skill of a worker in this art. Also, the present invention extends to the incorporation of this reconfigurable ability, rather than to any particular items which are being controlled.

A hole 74 is formed through the key such that the key can be attached to a key chain. A thumb hollow or space 76 is formed into the body of the key 70 and a surrounding wall 77 surrounds the thumb space 76. By providing the thumb space 76, the key 70 is constructed such that it is less likely that an operator will accidentally actuate one of the switches 64.

Figure 3B:
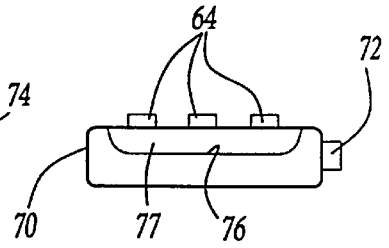
FIG. 3B is a cross-sectional view along line 3B—3B as shown in FIG. 3A.

As shown in FIG. 3B, the thumb space 76 being positioned rearwardly of the wall 77 reduces the likelihood of the operator's finger accidentally actuating one of the switches 64.

Figure 4A:
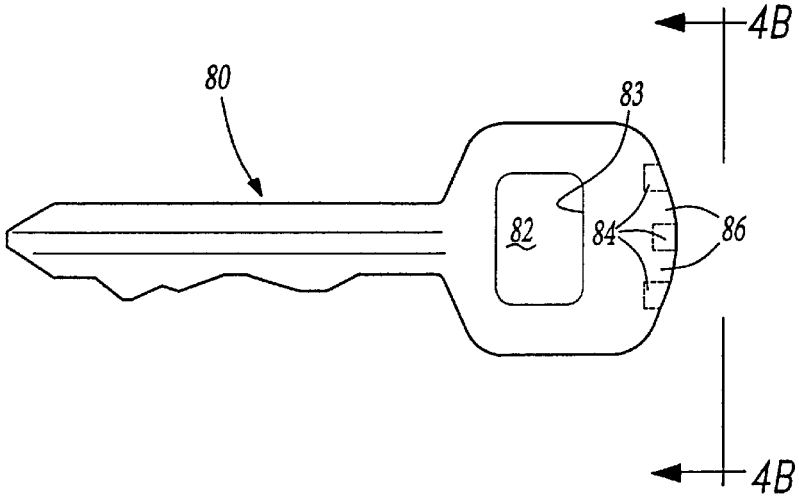
FIG. 4A shows a second embodiment key body.
Figure 4B:
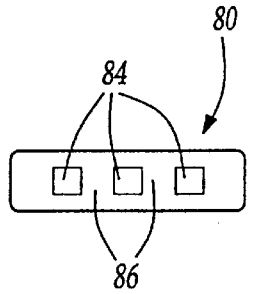
FIG. 4B is a cross-sectional view along line 4B—4B as shown in FIG. 4A.

FIG. 4A shows a second embodiment key 80. The view is partially cut away to show the switches in the end wall. The second embodiment key 80 incorporates a thumb space 82 positioned forwardly of a series of switches 84. A wall 83 also surrounds the thumb space 82. The switches 84 are positioned rearwardly of the thumb space 82, and recessed into an end wall in the body of the key. Thin walls 86 surround and separate the switches 84. As can be appreciated from FIG. 4B, due to the recessed mount for switches 84 in the end wall, it is less likely that an operator will accidentally actuate one of the switches.

The various controls and electrical connection that would be associated with the switches are well within the skill of a worker in this art.

Preferred embodiments of this invention have been disclosed, however, a worker of ordinary skill in this art would recognize that certain modifications come within the scope of this invention. For that reason, the following claims should be studied to determine the true scope and content of this invention.

What is claimed is:

1. A key system for a vehicle, comprising:

a key including a first pair of traces embedded in a body of the key and a transmitter embedded in a head of the key; and an antenna embedded into an interior component of the vehicle, the antenna including a pair of contact leads, wherein the pair of contact leads of the antenna align with the first pair of traces of the key when the key is inserted into an ignition of the vehicle, thereby electrically connecting the transmitter with the antenna.

2. The key system according to claim 1, further including a rechargeable battery embedded into the head of the key and a vehicular battery electrically connected to the pair of contact leads of the antenna, wherein the rechargeable battery of the key is charged by the vehicular battery when the key is inserted into the ignition of the vehicle.

3. The key system according to claim 2, further including a control for controlling electrical power from the vehicle battery to the battery of the key.

4. The key system according to claim 1, further including a battery embedded into the head of the key and a recharging circuit for recharging the battery.

5. The key system according to claim 1, further including a switch embedded in the head of the key for opening a garage door.

6. The key system according to claim 1, wherein the key includes a second pair of traces embedded in the body of the key, thereby allowing the key to be inserted in any orientation into the ignition of the vehicle.

7. The key system according to claim 6, wherein one of the first pair of traces comprises a positive trace and the other one of the first pair of traces comprises a negative trace, and wherein one of the second pair of traces comprises a positive trace and the other one of the second pair of traces comprises a negative trace.

8. The key system according to claim 1, wherein the key further includes a mode switch and one or more other switches.

9. The key system according to claim 8, wherein the mode switch allows changing of a mode of operation of the one or more other switches.

10. The key system according to claim 1, wherein the interior component is a steering wheel.

11. The key system according to claim 1, wherein the interior component is an interior trim component.

12. A key system for a vehicle, comprising:

a key including a first pair of traces embedded in a body of the key and a transceiver, a control, a memory, and a rechargeable battery embedded in a head of the key; and an antenna embedded into an interior trim component of the vehicle, the antenna including a pair of contact leads electrically connected to a battery of the vehicle, wherein the pair of contact leads of the antenna align with the first pair of traces of the key when the key is inserted into an ignition of the vehicle, thereby enabling the battery of the vehicle to recharge the rechargeable battery of the key.

13. The key system according to claim 12, wherein the key further includes a switch for disabling the vehicle.

14. The key system according to claim 12, further including a microphone coupled to the control of the key for recording messages from an operator.

15. The key system according to claim 14, wherein the recorded messages are stored in the memory of the key.

16. The key system according to claim 12, wherein the key includes a second pair of traces embedded in the body of the key, thereby allowing the key to be inserted in any orientation into the ignition of the vehicle.

17. The key system according to claim 16, wherein one of the first pair of traces comprises a positive trace and the other one of the first pair of traces comprises a negative trace, and wherein one of the second pair of traces comprises a positive trace and the other one of the second pair of traces comprises a negative trace.

* * * * *